US007670172B2

(12) United States Patent
Zhang et al.

(10) Patent No.: US 7,670,172 B2
(45) Date of Patent: Mar. 2, 2010

(54) MODULAR JACK ASSEMBLY

(75) Inventors: Hong-Bo Zhang, Kunshan (CN); Zheng-Hua Xu, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/069,373

(22) Filed: Feb. 7, 2008

(65) Prior Publication Data

US 2008/0194140 A1 Aug. 14, 2008

(30) Foreign Application Priority Data

Feb. 28, 2007 (CN) ..... 2007 2 0034624

(51) Int. Cl.
*H01R 13/60* (2006.01)
*H01R 13/66* (2006.01)

(52) U.S. Cl. ..... 439/540.1

(58) Field of Classification Search ..... 439/540.1, 439/545.1, 676, 79, 608, 595
See application file for complete search history.

(56) References Cited

U.S. PATENT DOCUMENTS 6,095,826 A 8/2000 Potters
6,409,525 B1 * 6/2002 Hoelscher et al. ..... 439/140
6,986,607 B2 * 1/2006 Roth et al. ..... 385/55
7,052,315 B2 5/2006 Murr et al.
7,384,310 B2 * 6/2008 Hu et al. ..... 439/607
2003/0199195 A1 * 10/2003 Koehler et al. ..... 439/541.5
2005/0282432 A1 * 12/2005 Murr et al. ..... 439/540.1
2007/0128939 A1 * 6/2007 Low et al. ..... 439/610

* cited by examiner

*Primary Examiner*—Chandrika Prasad
(74) *Attorney, Agent, or Firm*—Ming Chieh Chang; Wei Te Chung; Andrew C. Cheng

(57) ABSTRACT

A modular jack assembly includes first and second contact-holding inserts (10, 20) having first and second groups of interengaging elements (11 and 21, 12 and 22) between opposite bottom surfaces thereof. The first and second groups of interengaging elements are configured to interferentially engage the first contact-holding insert (10) with the second contact-holding insert (20) in respective first and second lateral and horizontal positioning directions (A, B). The second lateral and horizontal positioning direction (B) extends at approximately 90 degrees. from the first lateral and horizontal positioning direction (A). This arrangement will result in a reliable and stable positioning of the first contact-holding insert with respect to the second contact-holding insert.

13 Claims, 5 Drawing Sheets

MODULAR JACK ASSEMBLY

BACKGROUND OF THE INVENTION

1. Field of the Invention

The present invention relates to the art of electrical connectors, and more particularly to a modular jack assembly.

2. Description of the Related Art

U.S. Pat. No. 7,052,315 issued to Keith et al. on May 30, 2006 discloses a modular jack assembly including a first contact-holding insert and a second contact-holding insert disposed in a back-to-back mirror image relationship for forming upper and lower modular jack connectors. The first contact-holding insert interferentially engages with the second contact-holding insert by a plurality of groups of interengaging elements therebetween. Each group of interengaging elements includes a mounting peg in form of a cylindrical shape, and a corresponding multi-sided slot for mating with the mounting peg. The group of interengaging elements is utilized to provide an interference fit between the first contact-holding insert and the second contact-holding insert in at least two lateral and horizontal positioning direction. Such multi-direction interference fit for each group of interengaging elements may cause unreliable positioning of the first contact-holding insert with respect to the second contact-holding insert.

U.S. Pat. No. 6,095,826 issued to Paul on Aug. 1, 2000 discloses a related modular jack assembly also including groups of interengaging elements. At least one group of interengaging elements includes a multi-sided mounting peg, and a corresponding slot in form of circle shape for mating with the mounting peg. This multi-direction interference fit may also result in the unreliable positioning of the first contact-holding insert with respect to the second contact-holding insert.

Therefore, there is a need to provide a modular jack assembly to resolve the above-mentioned problem.

SUMMARY OF THE INVENTION

A modular jack assembly according to an embodiment of the present invention includes a first contact-holding insert and a second contact-holding insert. The first and second contact-holding inserts define bottom surfaces. First and second groups of interengaging elements are disposed between the opposite bottom surfaces of the first and second contact-holding inserts for engaging the first contact-holding insert with the second contact-holding insert. The first group of interengaging elements includes at least one first mounting peg and at least one first peg engagement slot for interferentially engaging the first contact-holding insert with the second contact-holding insert in a first lateral and horizontal positioning direction. The second group of interengaging elements includes at least one second mounting peg and at least one second peg engagement slot for interferentially engaging the second contact-holding insert with the first contact-holding insert in a second lateral and horizontal positioning direction, wherein the second lateral and horizontal positioning direction extends at approximately 90.degree. from the first lateral and horizontal positioning direction. This arrangement has the advantage that each group of interengaging element is utilized to interferentially engage the first contact-holding insert in a single direction, and the first contact-holding insert is held in position with respect to the second contact-holding insert by the interference fit of the first and second groups of interengaging elements in the first and second lateral and horizontal positioning directions. As compared with the prior art, this will result in a reliable and stable positioning of the first contact-holding insert with respect to the second contact-holding insert.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
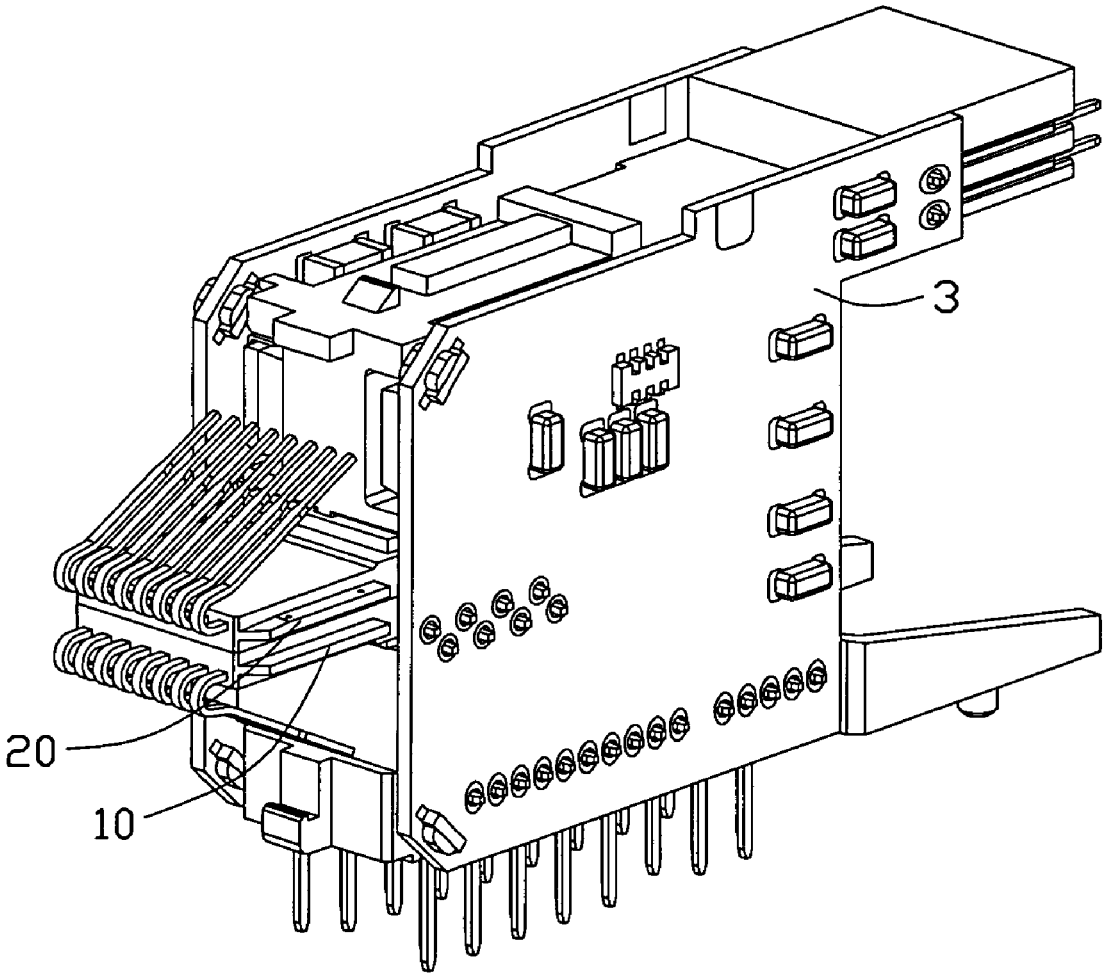
FIG. 1 is a perspective view of a part of a modular jack assembly according to an embodiment of the present invention.

Referring to FIGS. 1 to 5, a modular jack assembly according to an embodiment of the present invention generally includes a common main housing (not shown), and a contact-holding member 1 mounted within the main housing. The contact-holding member 1 further includes a first contact-holding insert 10 and a second contact-holding insert 20, with an immediate shield 30 disposed therebetween. The immediate shield 30 has a shape in correspondence with that of the first and second contact-holding inserts 10 and 20, and includes apertures 31 for interengaging elements (to be later described) to be extended therethrough, with a ground section 32 extending from a side edge of the immediate shield 30 for electrical connection to a ground region of a printed circuit board (not labeled).

The first contact-holding insert 10 and the second contact-holding insert 20 are arranged in a back-to-back mirror image relationship for forming upper and lower modular jack connectors. The first contact-holding insert 10 and the second contact-holding insert 20 define opposed upper surfaces, mutually facing first and second bottom surfaces 104 and 204, and side edges. First and second contacts 100 and 200, positioned on the respective first and second contact-holding inserts 10 and 20, include plug contact portions 101 and 201 extending adjacent to the opposite upper surfaces for engaging plug connectors (not shown) inserted therein, and printed circuit board contact portions 102 and 202 extending beyond the opposite side edges for connection to printed circuit boards (3), which are mounted orthogonally relative to the first and second contact-holding inserts 10 and 20. In this embodiment, the first and second contact-holding inserts 10 and 20 have the respective first and second contacts 100 and 200 over-molded therein.

Figure 3:
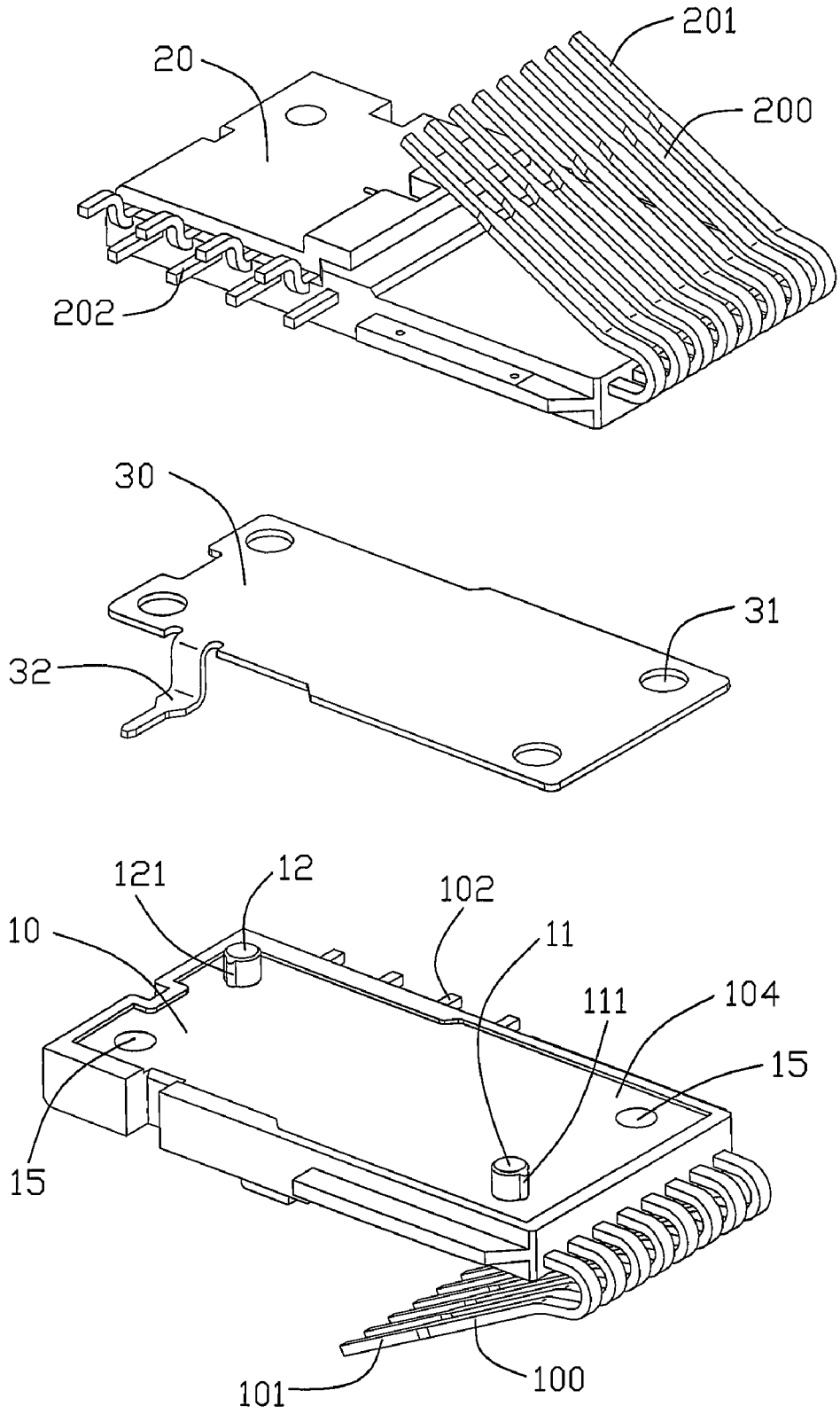
FIG. 3 is an exploded, perspective view of the contact-holding member of FIG. 2.
Figure 4:
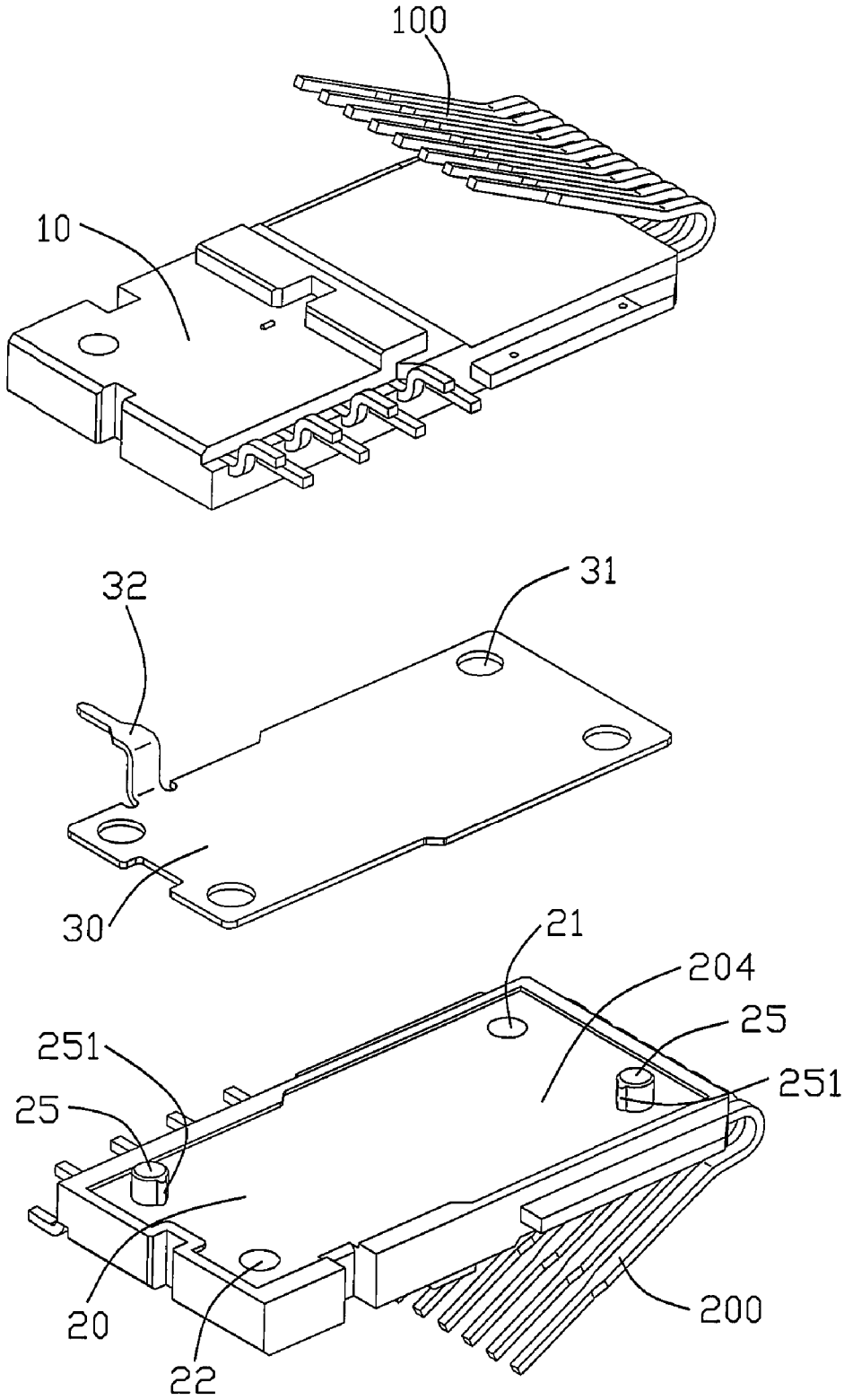
FIG. 4 is another exploded, perspective view of the contact-holding member of FIG. 2.
Figure 5:
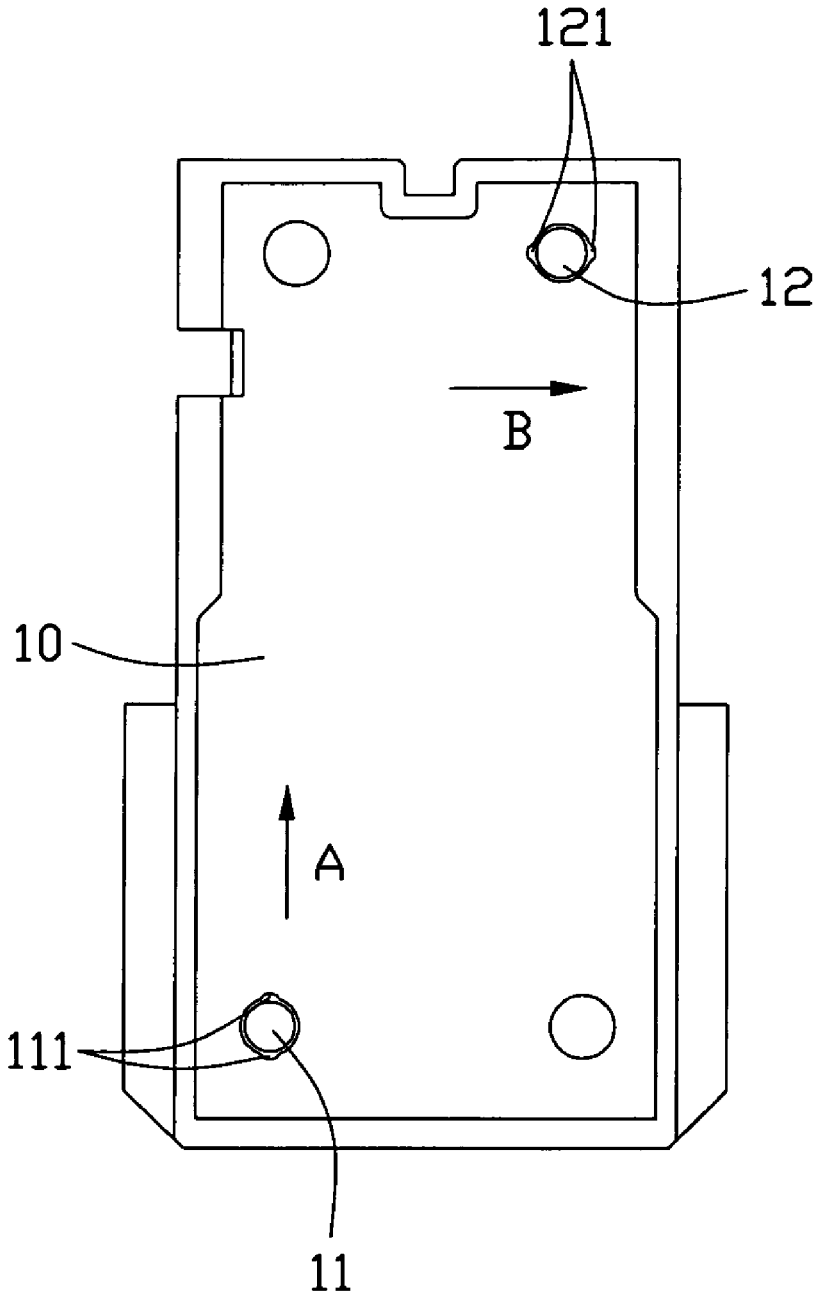
FIG. 5 is a bottom view of the first contact-holding insert of FIG. 3.

As shown in FIGS. 3 to 5, the first contact-holding insert 10 and the second contact-holding insert 20 includes a first group of interengaging elements 11 and 21, and a second group of interengaging elements 12 and 22 disposed between the opposite or mutually facing first and second bottom surfaces 104 and 204 thereof. The first group of interengaging elements 11 and 21 is configured for interferentially engaging the first contact-holding insert 10 with the second direction, indicated in FIG. 5 by the arrow "A", while the second group of interengaging elements 12 and 22 is configured for interferentially engaging the second contact-holding insert 20 with the first contact-holding insert 10 in a second lateral and horizontal positioning direction, indicated in FIG 5 by the arrow "B", wherein the second lateral and horizontal positioning direction "B" is angled from the first lateral and horizontal positioning direction "A". In this embodiment, the second lateral and horizontal positioning direction "B" extends at approximately 90 .degree. from the first lateral and horizontal positioning direction "A".

Each of said first and second groups of interengaging elements includes at least one mounting peg 11 or 12 or 25 extending from one of the opposite bottom surfaces of the first and second contact-holding inserts, and at least one corresponding peg engagement slot 21 or 22 or 15 extending from an opposite one of the opposite bottom surfaces. In FIG. 3, the first mounting peg 11 or 12 disposed on the first bottom surface 104 of the first contact-holding insert 10 further includes a pair of first axial sections 111 or 121 extending outwardly, longitudinally and radially of the mounting peg 11 or 12 for lateral and horizontal positioning of the first contact-holding insert 10 with respect to the second contact-holding insert 20. Each of the first axial section 111 or 121 is disposed along a peripheral portion of the first mounting peg 11 or 12 and adapted to extend from the first bottom surface 104 of the first contact-holding insert 10 toward the second bottom surface 204 of the second contact-holding insert 20 after the first contact-holding insert 10 and the second contact-holding insert 20 are engaged. In FIG. 4, the second mounting pegs 25 are disposed on the second bottom surface 204 of the second contact-holding insert 20 and each has a pair of second axial sections 251 disposed along a peripheral portion of the second mounting peg 25 and adapted to extend from the second bottom surface 204 of the second contact-holding insert 20 toward the first bottom surface 104 after the first contact-holding insert 10 and the second contact-holding insert 20 are engaged. The second mounting pegs 25 interferentially engage with the respective second peg engagement slots 15 in the first lateral and horizontal positioning direction and the second lateral and horizontal positioning direction different from the first lateral and horizontal positioning direction. In FIG. 5, the line defined by the pair of the first axial sections or tabs 111 or 121 extends at approximately 90 degrees. from the line defined by the pair of the second axial sections or tabs 111 or 121.

In this embodiment, each of the first and second groups of interengaging elements includes two mounting pegs 11 or 12 or 25, and two peg engagement slots 21 or 22 or 15 in correspondence with the mounting pegs 11 or 12 or 25. It can be seen that two first mounting pegs 11 and 12 (in FIG. 3), belonging to the respective first and second groups of interengaging elements, are shown to be on the first bottom surface 104 of the first contact-holding insert 10, while another two second mounting pegs 25 (in FIG. 4), belonging to the respective first and second groups of interengaging elements, are to be on the second bottom surface 204 of the second contact-holding insert 20. With reference to FIG. 5, these four mounting pegs between the first and second contact-holding inserts 10 and 20, together with the corresponding peg engagement slots, are located at respective corners of a rectangular or square. Two of the mounting pegs are respectively located at two corners in a diagonal line of the rectangle or square (shown in FIG 5), while another two mounting pegs are respectively located at corners in another diagonal line of the rectangle or square. In this embodiment, each of the first and second contact-holding inserts includes one mounting peg 11 or 25 belonging to the first group of interengaging elements, and another mounting peg 12 or 25 belonging to the second group of interengaging elements. This arrangement has the advantage that each mounting peg 11 or 12 or 25 is utilized to interferentially engage with the corresponding peg engagement slot. 21 or 22 or 15 in a single direction, and then the first contact-holding insert 10 is held in position with respect to the second contact-holding insert 20 by the interference fit of the mounting pegs with the corresponding peg engagement slots in the first and second lateral and horizontal positioning directions "A" and "B". As compared with the prior art, this arrangement will assure a reliable and stable positioning of the first contact-holding insert 10 with respect to the second contact-holding insert 20.

Figure 2:
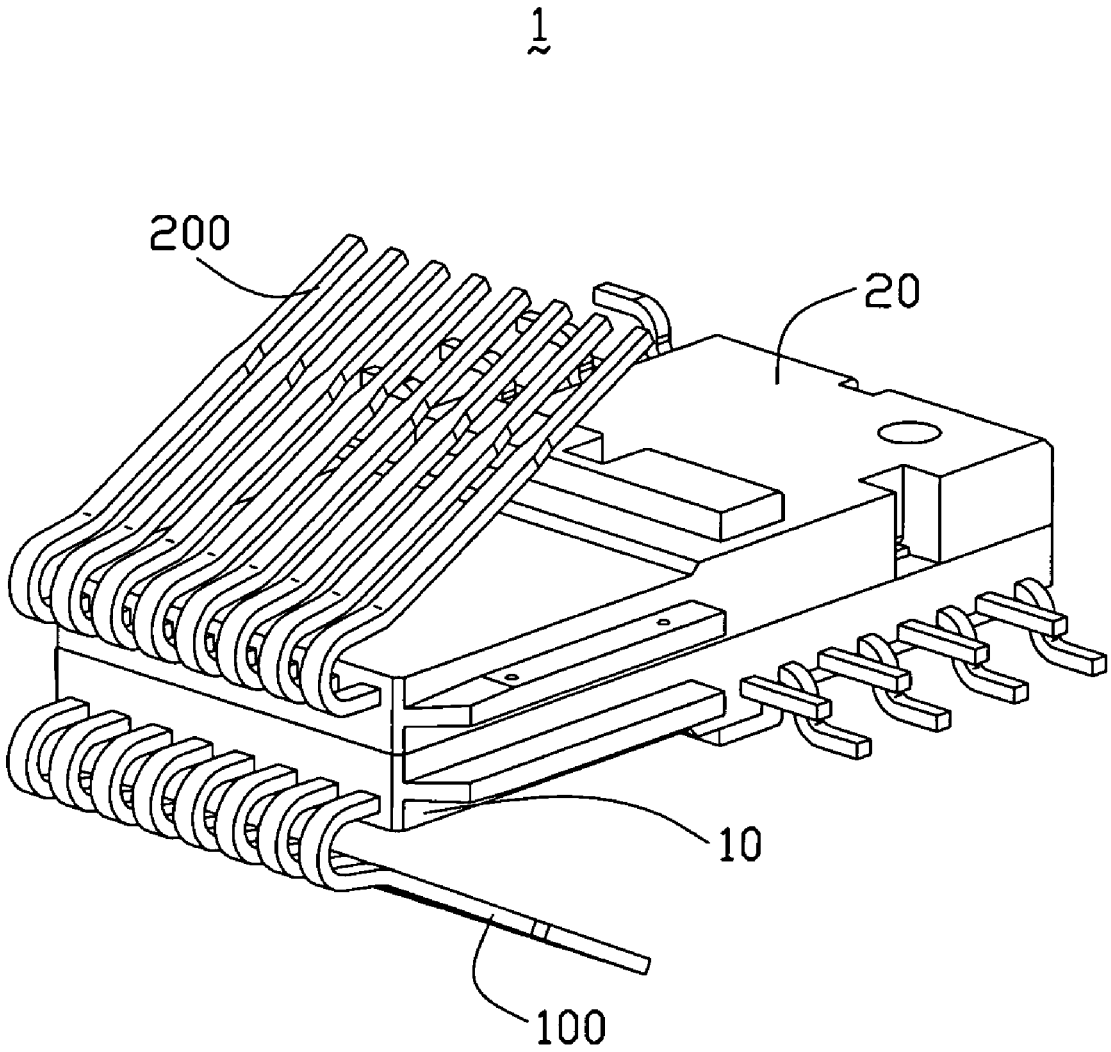
FIG. 2 is a perspective view of a contact-holding member of the modular jack assembly of FIG. 1, the contact-holding member including a first contact-holding insert and a second contact-holding insert.

Referring to FIGS 2 and 3, in assembly, the first contact-holding insert engages with the second contact-holding insert by the interference fit of the first and second groups of interengaging elements in both of the first and second lateral arid horizontal positioning direction, with the immediate shield arranged between the first and second contact-holding inserts. It is noted that in the embodiment the air of parallel printed circuit boards 3 are located by two sides of the stacked first and second contact-holding inserts in the transverse direction. On the other hand, the intermediate shield 30 is sandwiched between the stacked first and second contact-holding inserts in a vertical direction prendicular to said transverse direction so that the intermediate shield 30 cooperates with the pair of printed circuit boards 3 to commonly form an H-like structure in a front view.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. A modular jack assembly comprising:

a contact-holding member including a first contact-holding insert and a second contact-holding insert disposed in a stacked relationship and interengagable with each other for forming upper and lower modular jack connectors; and said first contact-holding insert and said second contact-holding insert including a first group of interengaging elements and a second group of interengaging elements disposed between mutually facing first and second surfaces of said first and second contact-holding inserts, respectively;

said first group of interengaging elements including at least one first mounting peg and at least one first peg engagement slot interferentially engaging with each other in a first horizontal positioning direction, said at least one first mounting peg disposed on said first surface, the first mounting peg having a first axial section disposed along a peripheral portion of the first mounting peg and adapted to extend from the first surface toward the second surface;

said second group of interengaging elements including at least one second mounting peg and at least one second peg engagement slot interferentially engaging with each other in a second horizontal positioning direction different from said first horizontal positioning direction, said at least one second mounting peg disposed on said first surface, the second mounting peg having a second axial section disposed along a peripheral portion of the second mounting peg and adapted to extend from the first surface toward the second surface.

2. The modular jack assembly of claim 1, wherein each of said first and second groups of interengaging elements includes two mounting pegs.

3. The modular jack assembly of claim 2, wherein said four mounting pegs together with the corresponding peg engagement slots are respectively located at each corner of a rectangle or square.

4. The modular jack assembly of claim 3, wherein two of the mounting pegs are respectively located at two corners in a diagonal line of the rectangle or square, and another two mounting pegs are respectively located at corners in another diagonal line of the rectangle or square.

5. The modular jack assembly of claim 1, wherein each of said first and second mounting pegs includes a pair of axial sections extending longitudinally and radially of said mounting peg for laterally and horizontally positioning of said first contact-holding insert with respect to said second contact-holding insert.

6. The modular jack assembly of claim 1, further comprising an intermediate shield disposed between said first contact-holding insert and said second contact-holding insert.

7. The modular jack assembly of claim 1, wherein said first and second contact-holding inserts respectively have first and second contacts over-molded therein.

8. The modular jack assembly of claim 7, wherein said first and second contact-holding inserts define opposed upper surfaces and side edges, said first and second contacts having respective plug contact portions extending adjacent to said corresponding upper surfaces, and respective printed circuit board contact portions extending beyond opposite side edges.

9. An electrical connector comprising:

a contact-holding member including a first contact-holding insert and a second contact-holding insert disposed in a stacked relationship and interengagable with each other for forming upper and lower modular jack connectors; and said first contact-holding insert and said second contact-holding insert including a first group of interengaging elements and a second group of interengaging elements disposed between mutually facing first and second faces of said first and second contact-holding inserts, respectively;

said first group of interengaging elements including at least one first mounting peg and at least one first peg engagement slot interferentially engaging with each other in a first transverse direction, said at least one first mounting peg disposed on said first face, the first mounting peg having a first axial section disposed along a peripheral portion of the first mounting peg and adapted to extend from the first face toward the second face;

said second group of interengaging elements including at least one second mounting peg and at least one second peg engagement slot interferentially engaging with each other in a second transverse direction different from said first transverse direction, said at least one second mounting peg disposed on said second face, the second mounting peg having a second axial section disposed along a peripheral portion of the second mounting peg and adapted to extend from the second face toward the first face.

10. The connector as claimed in claim 9, wherein the second transverse direction extends at approximately 90 degrees. from the first transverse direction.

11. The connector as claimed in claim 9, wherein a horizontal metallic shield is located between said first and second contact-holding insert, said horizontal metallic shield having a transverse grounding section extending from one side edge of said first contact-holding insert.

12. The connector as claimed in claim 9, wherein said first and second contact-holding inserts define opposed upper surfaces and side edges, said first and second contacts having respective plug contact portions extending adjacent to said corresponding upper surfaces, and respective printed circuit board contact portions extending beyond opposite side edges.

13. The modular jack assembly of claim 1, wherein the second horizontal positioning direction extends at approximately 90 degrees. from the first horizontal positioning direction.

* * * * *